US007006652B2

(12) United States Patent
Tomiyama et al.

(10) Patent No.: US 7,006,652 B2
(45) Date of Patent: Feb. 28, 2006

(54) SPEAKER DAMPER

(75) Inventors: Hiroyuki Tomiyama, Yamagata (JP); Satoshi Hachiya, Yamagata (JP)

(73) Assignees: Pioneer Corporation, Tokyo (JP); Tohoku Corporation, Yamagata (JP)

( * ) Notice: Subject to any disclaimer, the term of this patent is extended or adjusted under 35 U.S.C. 154(b) by 0 days.

(21) Appl. No.: 10/109,843

(22) Filed: Apr. 1, 2002

(65) Prior Publication Data

US 2002/0181731 A1 Dec. 5, 2002

(30) Foreign Application Priority Data

Mar. 30, 2001 (JP) ..... P. 2001-099663

(51) Int. Cl.
*H04R 25/00* (2006.01)

(52) U.S. Cl. ..... 381/404; 381/398; 381/403

(58) Field of Classification Search ..... 381/398, 381/423, 424, 426, 396, 400, 403–405; 29/594; 181/171–174, 166–170
See application file for complete search history.

(56) References Cited

U.S. PATENT DOCUMENTS

| | | | |
|---|---|---|---|
| 4,190,746 | A * | 2/1980 | Harwood et al. |
| 5,790,682 | A | 8/1998 | Hachiya et al. |
| 6,453,050 | B1 * | 9/2002 | Ogura et al. |

FOREIGN PATENT DOCUMENTS

| | | |
|---|---|---|
| JP | 09-307992 | 11/1997 |
| JP | 09-307993 | 11/1997 |

* cited by examiner

*Primary Examiner*—Suhan Ni
(74) *Attorney, Agent, or Firm*—Sughrue Mion, PLLC

(57) ABSTRACT

A butterfly damper for supporting a voice coil bobbin of a speaker on a frame in a state that the damper is vibrative. The butterfly damper is made of olefinic resin material having an internal loss of 0.045 or greater, a tensile elongation of 200% or greater, and a flexural modulus of 300 MPa or greater.

5 Claims, 6 Drawing Sheets

FIG. 2

PHYSICAL PROPERTY TABLE

| MATERIAL | POLYPROPYLENE | THERMOPLASTIC ELASTOMER | POLYBUTYLENE TELEPHTHALATE | POLYAMIDE |
|---|---|---|---|---|
| DENSITY (g/cc) | 0.9 | 0.9 | 1.2 | 1.02 |
| TENSILE STRENGTH (MPa) | 23 | 18 | 14 | 25 |
| TENSILE ELONGATION (%) | >830 | 700 | >500 | 250 |
| FLEXURAL MODULUS (MPa) | 980 | 1,100 | 300 | 490 |
| INTERNAL LOSS | 0.067 | 0.103 | 0.150 | 0.087 |
| FILLER NAME | — | | ELASTOMER | |

SPEAKER DAMPER

BACKGROUND OF THE INVENTION

1. Field of the Invention

The present invention relates to a damper for vibratively supporting parts contained in a vibrating system of a speaker.

2. Description of the Related Art

FIG. 5 is a sectional view showing a general structure of a speaker.

In FIG. 5, a damper 1 is located between a voice coil bobbin 2 and a frame 8. The damper 1 supports the voice coil bobbin 2 within a magnetic gap defined between the damper and a plate 5 that is mounted on a yoke 3 and a magnet 4 in a state that the voice coil bobbin 2 is vibratable in its axial direction.

In FIG. 5, reference numeral 6 designates a vibration plate and 7 designates an edge.

In some speakers each having such a structure, a butterfly damper as shown in FIG. 6 is used for the damper 1.

In the butterfly damper 1, an outer frame 1A to be mounted on the frame 8 and an inner frame 1B to be mounted on the voice coil bobbin 2 are connected by arm parts 1C, which are integrally formed with those frames. The butterfly damper is injection molded of thermoplastic resin.

Conventionally, polybutylene terephthalate (PBT) whose tensile strength is 46 MPa, tensile elongation is 200%, flexural modulus is 2200 MPa, and internal loss is 0.014, is used for the thermoplastic resin forming the butterfly damper 1.

The butterfly damper 1 may be formed to have partial non-uniform sections, and has a satisfactory follow-ability for a vibration of the voice coil bobbin 2.

In the conventional butterfly damper 1 molded of the polybutylene terephthalate (PBT), an unnecessary resonance sometimes occurs in the arm parts 1C at a frequency higher than the lowest resonance frequency $f_o$ of the speaker. As the resonance grows, the quality of a sound generated by the speaker is adversely affected by the resonance. In an extreme case, the coupling parts between the arm parts 1C and the outer and inner frames 1A and 1B will be broken.

More exactly, in the butterfly damper 1 made of the material having physical property values as mentioned above, peaks appear in the impedance curve at sound pressure peak levels within a frequency range from 1000 to 2000 Hz, as shown in FIG. 7. At this time, there is a danger that a resonance sound is generated or the arm parts 1C are broken.

The butterfly damper is made of polybutylene terephthalate (PBT) whose tensile strength is 25 MPa, tensile elongation is 300%, flexural modulus is 800 MPa, and internal loss is 0.044. The resonance frequency of the damper shifts to a low frequency region, but this does not lead to the complete prevention of the generation of the unwanted resonance.

There is a damper whose surface is coated with damping compound, for example, in order to prevent the resonance of the butterfly damper 1. The coating of the damping compound results in increase of the number of the steps of manufacturing the butterfly damper, and hence increase of the cost to manufacture.

SUMMARY OF THE INVENTION

The present invention has been made to solve the above-mentioned problems of the conventional damper for speaker.

An object of the invention is to provide a speaker damper which is able to suppress unnecessary resonance in arm parts thereof, and prevent the sound quality from being affected by the resonance, and avoid being broken by vibration, and further bring no increase in manufacturing cost to avoid the resonance.

To achieve the above object, according to a first aspect of the invention, there is provided a speaker damper vibratively supporting the parts in a vibrating system of a speaker on a frame of the butterfly damper, the improvement being characterized in that the butterfly damper is molded of a resin material whose internal loss is 0.045 or larger.

In the first aspect of the invention, the resin material having an internal loss of 0.045 or larger is used for the material of the butterfly damper. With use of such a material, the resonance level of the damper reduces to suppress the generation of a resonance sound of the damper.

Accordingly, the resonance is prevented from affecting the sound quality.

Further, there is no case that by preventing the resonance occurrence, the number of steps of manufacturing the butterfly damper is increased, and hence increase the manufacturing cost.

According to the second aspect of the invention, the resin material of the butterfly damper has physical property values: the tensile elongation is 200% or greater and the flexural modulus is 300 MPa or greater in addition to those of first embodiment.

In the second aspect of the invention, the internal loss of the resin material of the butterfly damper is 0.045 or larger, and further the tensile extensible property of the resin material is sufficiently large, 200% or higher. Therefore, there is prevented that the stress generated through the vibration of the parts in the vibrating system that the butterfly damper supports damages the parts of the butterfly damper, which vibratively supports the parts in the vibrating system. Further the bending modulus of the resin material, which has the physical property values mentioned above, is sufficiently large, 300 MPa or higher. This feature ensures its supporting force large enough to support the parts in the vibrating system. Therefore, it is prevented that when the parts of the vibrating system vibrate, an abnormal vibration, e.g., lateral vibration, occurs.

According to a third aspect of the invention, the resin material is an olefinic resin material in addition to those of first aspect of the invention.

In the third aspect of the invention, olefinic resin material is used for the material of the butterfly damper. With use of such a material, a specific gravity of the damper is decreased and its weight is reduced, and a sensitivity of the damper for the vibration is increased. Additionally, when the damper formed of the material is compared with the conventional damper whose size is equal to that of the former, the internal loss of the former damper is increased, and hence a resonance level of the former butterfly damper is lowered.

According to the fourth aspect of the invention, the butterfly damper includes an outer frame part being mounted and supported on the frame of the speaker, an inner frame part, which is mounted on the parts contained in the vibrating system of the speaker and supports those parts, and a plurality of arm parts bridging between the inner frame part and the outer frame part and vibratively supporting the inner frame on the outer frame part, and the inner frame part, the outer frame part and the arm parts are respectively molded of the resin material.

In the forth aspect of the invention, the parts in the vibrating system such as the voice coil bobbin and the vibration plate of the speaker are supported by the inner frame part, which is connected, by the arm parts, to the outer frame part mounted and supported on the frame side of the speaker. Therefore,a follow-ability of the speaker damper for a vibration of the parts in the vibrating system is satisfactorily secured. Additionally, the inner frame part, the outer frame part and the arm parts, which form butterfly damper, are molded of the resin material whose internal loss is 0.045 or larger. Therefore, it is prevented that unnecessary resonance occurs.

According to a fifth aspect of the invention, the inner frame part, the outer frame part and the arm parts of the butterfly damper are integrally formed by injection molding. With this feature, a follow-ability of the speaker damper for a vibration of the parts in the vibrating system is satisfactorily secured, and the lowering of resonance level is realized.

BRIEF DESCRIPTION OF THE DRAWINGS

FIG. 2 is a table showing physical property values of resin materials used for the speaker damper of the invention.

DETAIELD DESCRIPTION OF THE PRESENT INVENTION

The present invention will be described with reference to the accompanying drawings.

A butterfly damper of the invention is injection molded of thermoplastic resin having physical property values: the internal loss is 0.045 or greater (internal loss at 1000 Hz); the tensile elongation is 200% or greater; and the flexural modulus is 300 MPa or greater.

By using the material whose internal loss is 0.045 or greater, a resonance level of the damper is lowered, and generation of a resonance sound of the damper is suppressed.

Figure 1:
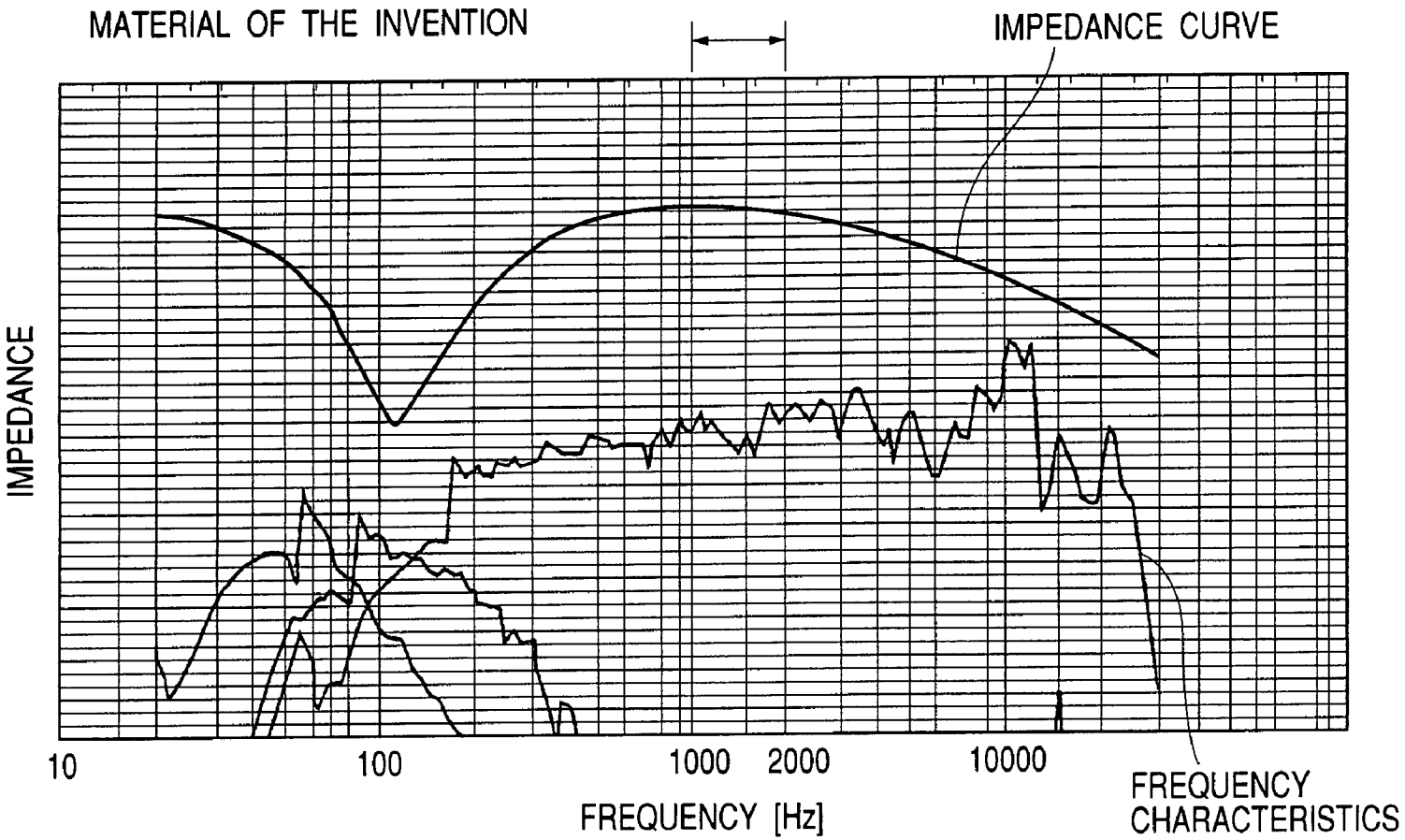
FIG. 1 is a graph showing an impedance curve of a damper of the invention, which is used for a speaker.
Figure 7:
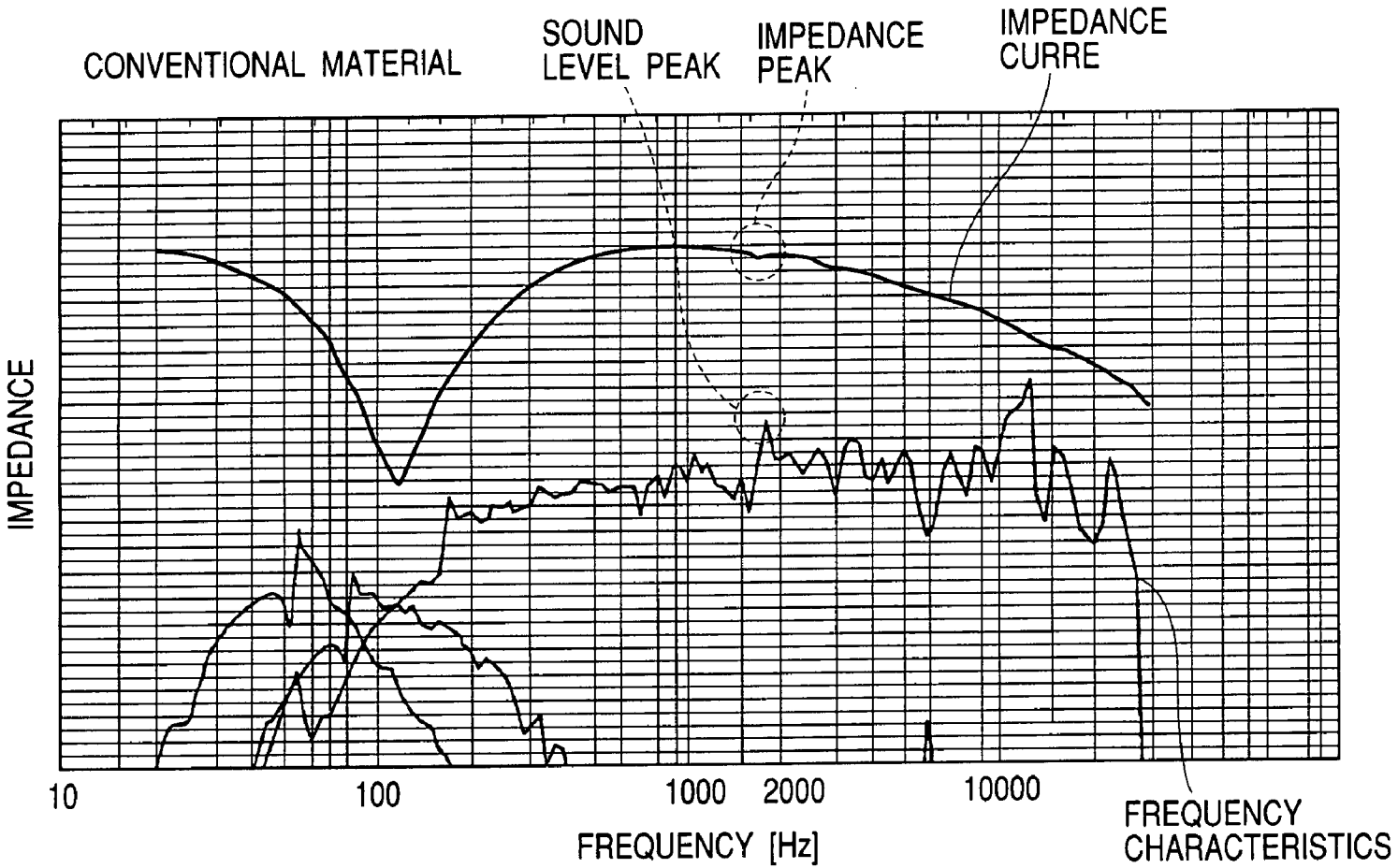
FIG. 7 is a graph showing an impedance curve of the conventional butterfly damper.

As seen from the comparison of FIG. 1 showing the frequency characteristics of the butterfly damper made of the material having the physical properties mentioned above, and FIG. 7 showing the frequency characteristics of a conventional damper, the butterfly damper made of the material having the physical properties as mentioned above is free from peaks which appear on the impedance curve within a frequency range of 1000 to 2000 Hz in the conventional butterfly damper.

In the damper made of the material whose internal loss is 0.045 or greater, but tensile elongation is less than 200%, arm parts (see FIGS. 4 to 6) of the butterfly damper are easily damaged by the stress generated when the damper vibrates. In the case of the material whose flexural modulus is less than 300 MPa, the supporting force of a voice coil bobbin is weak, so that the voice coil bobbin is easy to roll (laterally vibrate). However, when the butterfly damper is made of the material whose tensile elongation is 200% or higher and flexural modulus is 300 MPa, it is prevented that the arm parts are damaged, and the supporting force is reduced.

Examples of the butterfly damper materials are the following materials having the physical properties as mentioned above: polypropylene (PP), polybutylene terephthalate (PBT: elastomer loading amount is 5% to 50%), polyamide (PA), and thermoplastic elastomer (TPO). Physical property values of those materials are as shown in FIG. 2.

The amount of elastomer loaded into the polybutylene terephthalate (PBT) varies depending on physical property values of the elastomer to be loaded. An example of the elastomer loading amount is 50 wt % of the elastomer loaded into the PBT whose flexural modulus is 170 MPa, and tensile elongation at break is 850%.

Where the butterfly damper 1 is formed of olefinic resin material having the physical property values as mentioned above, a specific gravity of the damper is decreased and its weight is reduced, and a sensitivity of the damper for the vibration is increased. Additionally, when the damper formed of the material is compared with the conventional damper whose size is equal to that of the former, the resonance frequency of the former damper is increased and the internal loss is increased, and hence a resonance level is lowered.

Further, materials having high Young's modulus and high internal loss are preferable for the material of the butterfly damper of the embodiment. Of the materials as described above, the material having physical property values of Young's modulus and specific gravity as given below are preferably used.

| | | |
|---|---|---|
| a. | Young's modulus: | $0.89 \times 10^9 N/m^2$ |
| | internal loss: | 0.089 |
| | specific gravity: | 0.89 |
| b. | Young's modulus: | $0.90 \times 10^9 N/m^2$ |
| | internal loss: | 0.099 |
| | specific gravity: | 1.23 |
| c. | Young's modulus: | $0.97 \times 10^9 N/m^2$ |
| | internal loss: | 0.150 |
| | specific gravity: | 1.20 |

Figure 3:
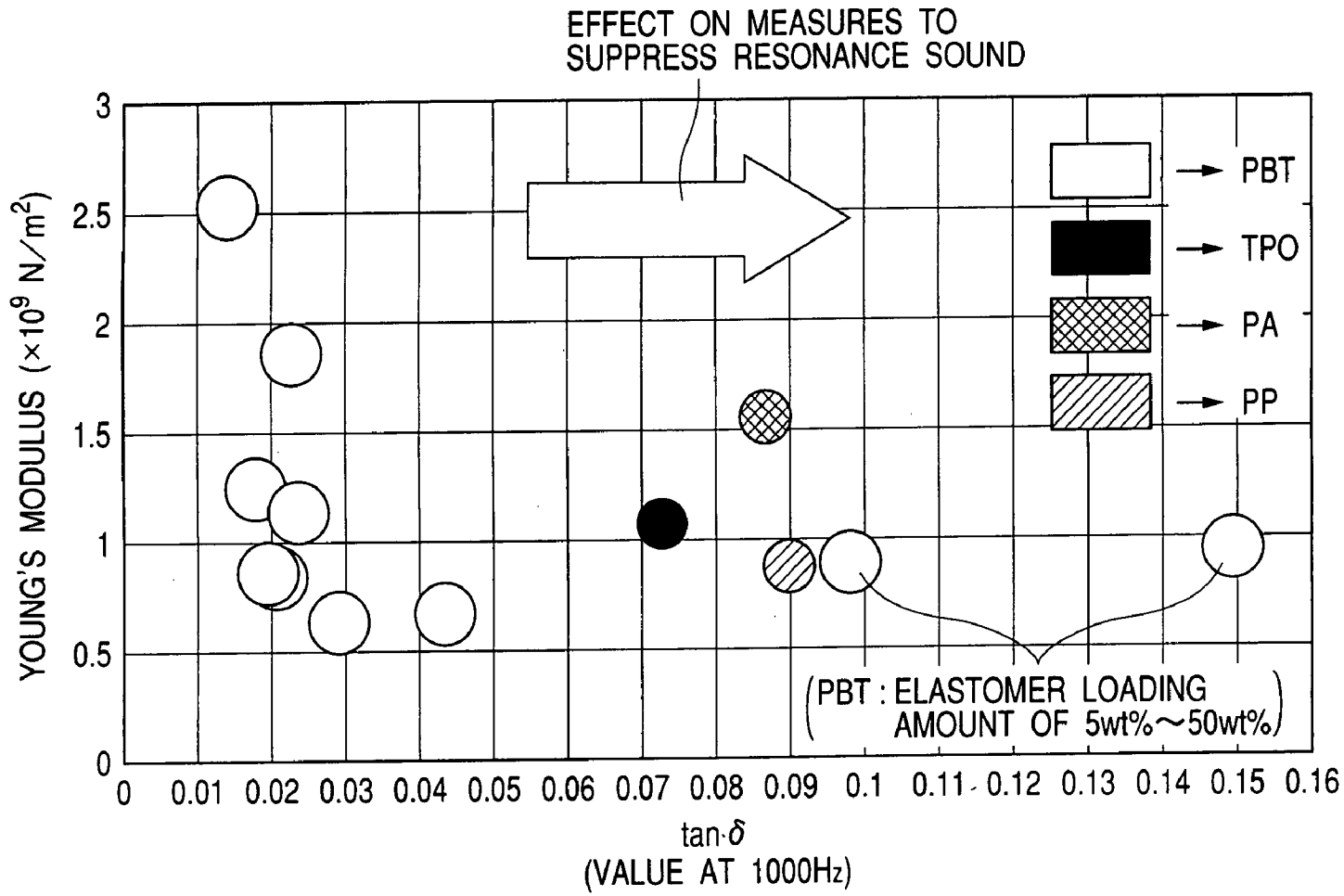
FIG. 3 is a graph showing relationships between Young's moduli of materials and the effects of the measure taken for suppressing the resonance sound of the butterfly damper.

FIG. 3 is a graph showing relationships between Young's modulus of materials and the effects of the measure taken for suppressing the resonance sound of the butterfly damper. As seen from the graph, polybutylene terephthalate (PBT: elastomer loading amount is 5% to 50%) having Young's modulus of $1.00 \times 10^9 N/m^2$ or less as mentioned above, has an excellent effect of the resonance sound suppressing measure.

Figure 6:
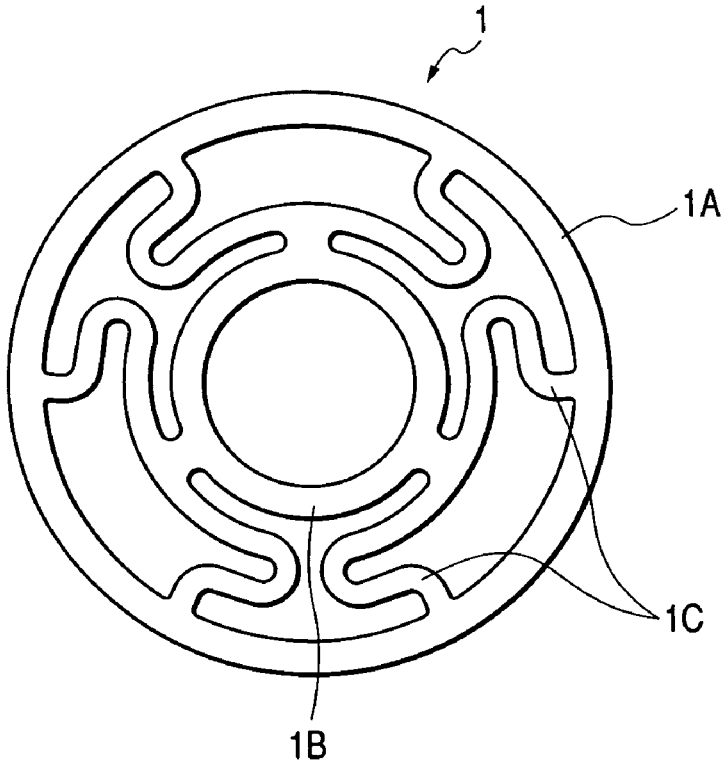
PRIOR ART FIG. 6
FIG. 6 is a plan view showing a conventional butterfly damper.

The butterfly damper formed of the material having physical property values as mentioned above may take an elliptic shape (FIG. 4) as well as a circular shape (FIG. 6).

Figure 4:
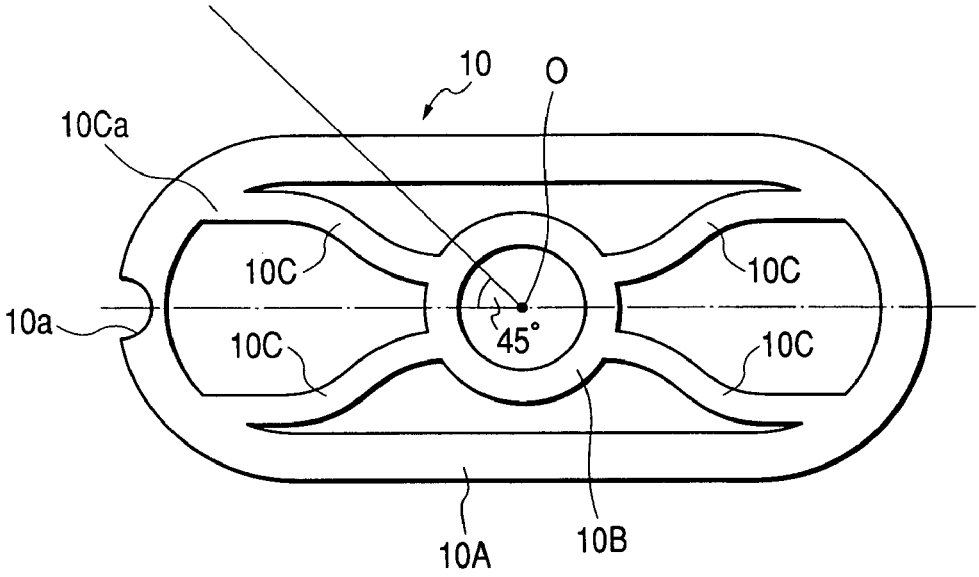
FIG. 4 is a plan view showing an exemplar configuration of the speaker damper of the invention.
Figure 5:
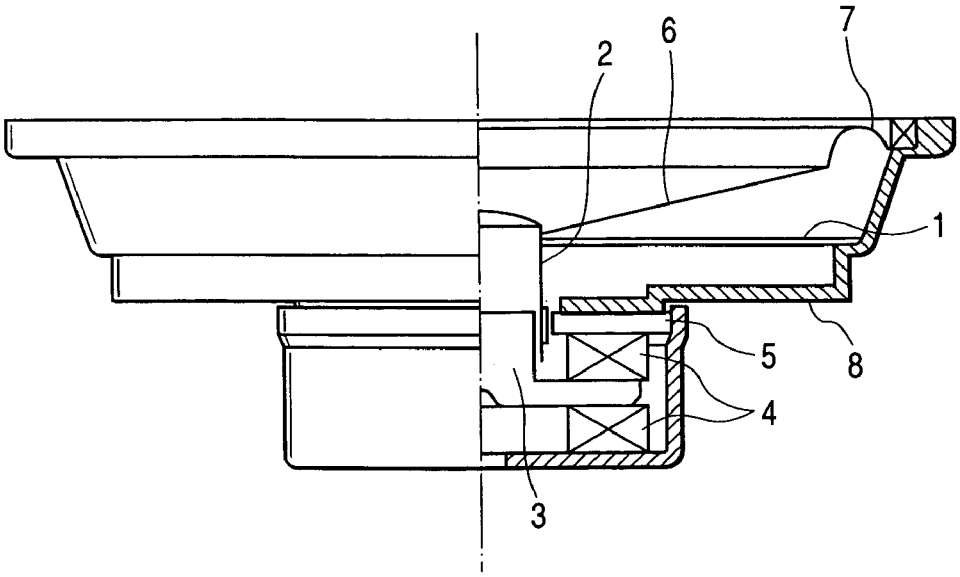
PRIOR ART FIG. 5
FIG. 5 is a sectional view showing a structure of a conventional speaker.

An elliptic shaped butterfly damper 10 of FIG. 4 is integrally formed with an outer frame 10A, an inner frame 10B, and four arm parts 10C. The outer frame 10A is supported on the frame side of a speaker when the butterfly damper is mounted on the speaker. The inner frame 10B is fit to the outer peripheral surface of the voice coil bobbin and supports it. The arm parts 10C connect the inner frame 10B to the outer frame 10A in a state that the inner frame 10B is vibrative.

In FIG. 4, reference numeral 10*a* is a positioning cutout for positioning the elliptically shaped butterfly damper 10 onto the frame of the speaker.

In the elliptic butterfly damper 10, coupling parts 10Ca of the arm parts 10C are each located within an angular range defined by an angle of 45° with respect to the major axis of the damper as measured about the center "O" of the elliptic butterfly damper 10. The elliptic butterfly damper thus so constructed has the follow-up characteristics for the vibration comparable with those of the circular damper whose radius is equal to the major axis length of the outer frame 10A.

The elliptic shaped butterfly damper 10 thus constructed, is formed by injection molding by using thermoplastic resin, as described above, having physical property values such that internal loss is more than 0.045 (internal loss at 1000 Hz), tensile elongation is more than 200%, and flexural modulus is more than 300 MPa. Therefore, the elliptic shaped butterfly damper has the sufficient follow-up characteristics for the vibration of the voice coil bobbin, and unnecessary resonance of the arm 10C is suppressed, thereby the breaking caused by the resonance is avoided.

Further, the number of manufacturing steps is not increased for suppressing the generation of the unwanted resonance, and hence the cost to manufacture is not increased.

What is claimed is:

1. A butterfly damper for vibratively supporting thereon a member in a vibrating system of a speaker, the butterfly damper made of a resin material having an internal loss of 0.045 or larger, and comprising:

an outer frame to be mounted and supported on a frame of the speaker;

an inner frame to be mounted on the member of the vibrating system of the speaker, the inner frame for supporting the member of the speaker, and a plurality of arms bridging between the inner frame and the outer frame, the arms vibratively supporting the inner frame onto the outer frame, wherein the inner frame, the outer frame and the arms are respectively molded of the resin material, wherein the resin material is polybutylene terephthalate in which an elastomer loading amount is 5 to 50% by weight, and the resin material has a Young's modulus of $1.00\times10^9 N/m^2$ or less.

2. A butterfly damper for vibratively supporting thereon a member in a vibrating system of a speaker, the butterfly damper made of a resin material having an internal loss of 0.045 or larger, wherein the resin material has a Young's modulus of $0.89\times10^9 N/m^2$, an internal loss of 0.089 and a specific gravity of 0.89.

3. A butterfly damper for vibratively supporting thereon a member in a vibrating system of a speaker, the butterfly damper made of a resin material having an internal loss of 0.045 or larger, wherein the resin material has a Young's modulus of $0.90\times10^9 N/m^2$, an internal loss of 0.099 and a specific gravity of 1.23.

4. A butterfly damper for vibratively supporting thereon a member in a vibrating system of a speaker, the butterfly damper made of a resin material having an internal loss of 0.045 or larger, wherein the resin material has a Young's modulus of $0.97\times10^9 N/m^2$, an internal loss of 0.150 and a specific gravity of 1.20.

5. The butterfly damper according to claim 1, wherein the Young's modulus of the resin material is substantially $1\times10^9 N/m^2$ or less.

* * * * *